US005501657A

United States Patent [19]

Feero

[11] Patent Number: 5,501,657

[45] Date of Patent: Mar. 26, 1996

[54] METHOD OF ALLEVIATING CARPAL TUNNEL SYNDROME

[76] Inventor: Andrew A. Feero, 3069 W. 11th Ave. Cir., Broomfield, Colo. 80020

[21] Appl. No.: 380,104

[22] Filed: Jan. 30, 1995

[51] Int. Cl.[6] ..... A61H 7/00

[52] U.S. Cl. ..... 601/40; 601/33; 128/898

[58] Field of Search ..... 482/44–46, 131, 482/907; 601/33, 40; 128/898

[56] References Cited

U.S. PATENT DOCUMENTS

| | | | |
|---|---|---|---|
| 5,239,986 | 8/1993 | Hermelin | 128/898 |
| 5,441,058 | 8/1995 | Fareed | 128/898 |

OTHER PUBLICATIONS

Alan R. Bonebrake, D.C., "A Treatment for Carpal Tunnel Syndrome: Results of Follow-up Study", Journal of Manipulative and Physiological Therapeutics, vol. 17, No. 8, pp. 565–567, Oct. 1994.

Benjamin M. Sucher, DO, "Myofascial release of carpal tunnel syndrome", The Journal of the American Osteopathis Association, vol. 93, No. 1, pp. 92–94, 100, and 106, Jan. 1993.

Benjamin M. Sucher, DO, "Palpatory diagnosis and manipulative management of carpal tunnel syndrome", The Journal of the American Osteopathic Assoc., vol. 94, No. 8, pp. 647–663, Aug. 1994.

Richard Valente, "Chiropractic Therapy on Carpal Tunnel Syndrome: A Case Study", ACA Journal of Chiropractic, vol. 28, No. 6, pp. 76–78, Jun. 1991.

*Primary Examiner*—Lynne A. Reichard
*Assistant Examiner*—Jeanne M. Clark
*Attorney, Agent, or Firm*—Crossetta & Associates

[57] ABSTRACT

This invention relates to a neuromuscular therapeutic method for the relief of pain associated with carpal tunnel syndrome in humans, comprising soft tissue manipulation, deep tissue manipulation and nerve entrapment manipulation, generally applied in forearm and hand massage and manipulation which is effective in reducing the pain known and associated with the medical term carpal tunnel syndrome.

6 Claims, 6 Drawing Sheets

FIG-4
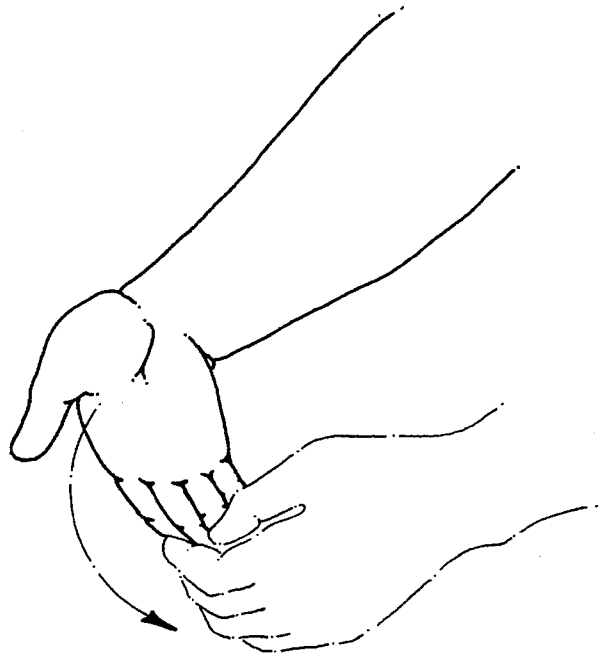
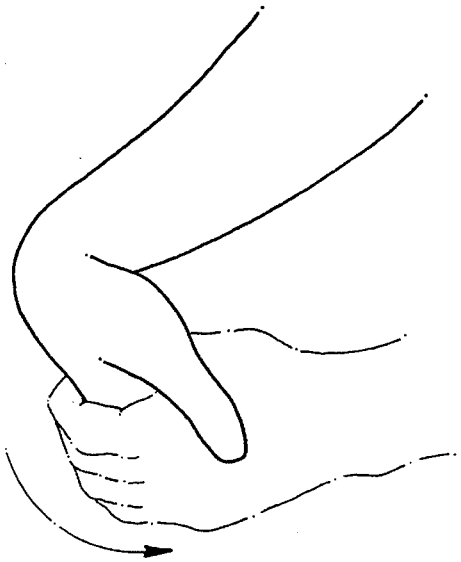
FIG-4a
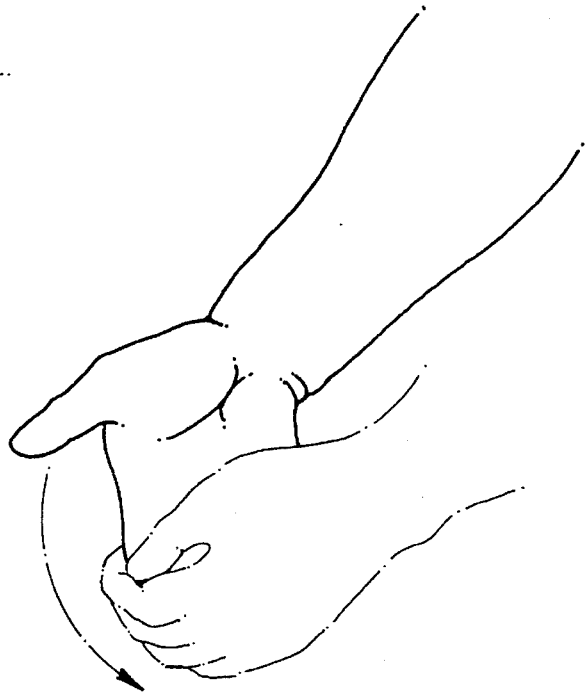
FIG-4b

METHOD OF ALLEVIATING CARPAL TUNNEL SYNDROME

This invention, relates to a neuromuscular therapeutic method for the relief of pain associated with the human condition generally known as carpal tunnel syndrome. More particularly, this invention is directed to a method of elbow, arm, wrist and hand neuromuscular therapy and manipulation which have been found to effectively reduce the pain, ischemic condition, inflammation, numbness and related discomforts known and associated with the symptoms of carpal tunnel syndrome.

BACKGROUND OF THE INVENTION

Carpal tunnel syndrome appears to be of increasing presence in modern society and is thought to result from repetitive hand movements, particularly repetitive movements which are associated with dexterous finger movement such as which occur in computer keyboard operation, sewing, retail clerking, dentistry and the like. Carpal tunnel syndrome is a medically diagnosed condition which commonly refers to soreness, tenderness, numbness and/or pins and needles sensations in the hand which are thought to occur through the compression of the median nerve from pressure of the palmaris longus tendon as they pass between the radial and ulna bone set and the transverse carpal ligament of the wrist. Inflammation can decrease blood circulation in the arm and create a painful ischemic condition.

Conventional medical treatment of mild carpal tunnel syndrome is generally recuperative rest from the repetitive action, optionally coupled with support of the hand-wrist-forearm through wrist splint means and medicaments such as cortisone or the like. Such conservative treatment enjoys some success, particularly when the problem is mild and the repetitive action can be avoided and/or interrupted for extended periods of time.

The job demands of modern society find the typical patient with more acute symptoms, and more and more frequently invasive surgery is considered as the treatment of choice for enabling the patient to return to an employment environment which requires the repetitive action which is the causal protagonist of the syndrome. Surgery is generally performed in such manner as to divide the transverse carpal ligament in such manner as to relieve pressure on the median nerve. Surgery, generally results in a permanent loss in range of motion and has not achieved high success rates in solving recurrence of the problem, it being estimated that of the various surgical procedures intended to relieve the syndrome the failure rates are anywhere from 50 to 75%.

There is a continuing need for a non-invasive therapeutic method for alleviating carpal tunnel syndrome. There is particular need for a non-invasive therapeutic method which enables recovery from carpal tunnel syndrome, which does not require long periods of inactivity from repetitive action and does not result in a permanent loss of range of movement.

The treatment of disease, through the manipulation of joints and muscles of the body as practiced in chiropody and physical therapy, is well known and has enjoyed resurgent success in the healing arts. In recent years, physical therapy has attempted to provide treatment methods for alleviating carpal tunnel syndrome but no present treatment method has enjoyed significant success. In the traditional manipulative treatment of carpal tunnel syndrome, the focus of manipulation is generally on treatment of the area directly surrounding the carpal tunnel, so as to reduce inflammation in the area and provide a temporary measure of mild relief to the patient. No traditional method appears as known which provides lasting and significant relief.

It is an object of the present invention to provide a non-invasive, medicament free method to alleviate carpal tunnel syndrome which has a high success rate and a longer lasting effect.

It is a further object of the present invention to provide a manipulative method which is effective in relieving the painful inflammation, ischemic conditions and sensations of carpal tunnel syndrome.

It is a still further object of the present invention to provide a therapeutic method wherein muscle and nerves are manipulated to effectively relieve the painful inflammation, ischemic conditions and soreness sensations known as carpal tunnel syndrome without splints, injections or invasive surgical action.

These and other objects of the invention will be apparent from the following description.

BRIEF DESCRIPTION OF THE INVENTION

The present invention is a therapeutic manipulative method for alleviating carpal tunnel syndrome, which comprises ergonomic correction, exercise, soft tissue manipulation, deep tissue manipulation, nerve entrapment manipulation and trigger point therapy, applied to the forearm, elbow, wrist and hand of a person.

In a first stage of the method, the focus is on reducing the ischemic condition and inflation by exercising the forearm, elbow, wrist and hand in an amount sufficient to stretch forearm and flexor cavity musculature. The flexor cavity is then subjected to basic soft tissue manipulation sufficient to reduce inflammation, increase circulation and alleviate the ischemic condition. The stretching exercise focuses on the flexor cavity and muscles appending the tendons passing through the carpal tunnel. The specific intent is to stretch the flexor muscles and/or attain longitudinal displacement of the tendons which pass through the carpal tunnel, such as the flexor digitorum profundus, flexor digitorum superficialis, flexor carpi radialis, brachioradialis, palmaris longus and flexor retinaculum. The soft tissue manipulation focuses on the area of the flexor cavity, the transverse carpal ligament and the reduction of inflammation in the area thereabout to relieve the pain cycle and increase the range of motion of the wrist.

In a second stage of the method, the focus of the manipulation is again on increasing circulation and reducing inflammation about the flexor cavity, and comprises soft tissue manipulation, particularly of the palmaris longus and palmaris brevis and ice therapy or the like to that area. It is believed that inflammation of the soft tissue about the flexor cavity tends to engorge the flexor cavity, which in turn decreases circulation and the available space through which the median nerve and the various tendons can pass. It is believed that the decrease in circulation and space causes pressure against the median nerve thus resulting in a decrease in range of motion and the sensations of carpal tunnel syndrome.

In a third stage of the method, manipulation is focused on the flexor cavity, particularly the palmaris longus which extends from the vicinity of the medial epicondyle to about the wrist. Deep tissue manipulation is imposed, sufficient to promote the elongation of musculature that accompanies movement of the digits, thumb and flexion and extension action of the hand about the wrist. The manipulation is applied longitudinally along the forearm, progressively along the musculature in a direction from the elbow, medial epicondyle, toward the wrist, transverse carpal ligament, in a manner sufficient to promote taunt band release. The progressive longitudinal manipulation effort is interspaced with moderate progressive cross fiber friction manipulation to promote reduction of facia congestion, reduction of inflammation and increased blood circulation in the musculature about the flexor cavity and wrist.

Trigger point therapy is instituted during the deep tissue manipulative process and comprises a known physical therapy technique which works to resolve the symptoms of myofascial trigger points and identify the causes for their development and perpetrating factors if they are recurrent.

A trigger point comprises a hyperirritable spot, usually found with a taunt band of skeletal muscle or in the muscle facia, that is painful on compression and usually gives rise to characteristic referred pain, tenderness and autonomic phenomena. An active trigger point is associated with arm pain, a latent trigger point is silent with respect to arm pain, but both will cause restrictive movement and create weakness in the affected muscle.

It is believed that the soft tissue manipulation about the carpal tunnel, forearm and elbow provides a reduction of inflammation and increased blood circulation that enables the flexor cavity to approach normal sizing and range of motion. Neuromuscular therapy applied to the palmaris longus and the palmaris brevis appears to reduce the inflammation and increase circulation about the flexor cavity. The deep tissue manipulation of the forearm musculature appears to induce a relaxation and/or longitudinal displacement of various muscles and tendons passing through the flexor cavity. The combination of relaxed and/or displaced muscles and tendons of the flexor cavity mitigates and approaches normal size, relieving pressure against the median nerve and appears to be the basis for the resulting alleviation of symptoms of carpal tunnel syndrome and increase in the range of motion.

In a fourth stage of the invention, the results achieved in reduction of inflammation, increased blood circulation and relaxation and/or displacement of muscles and tendons in the flexor cavity are further improved and stabilized. In this stage, inflammation is further reduced, blood circulation is increased and are stabilized by manipulation alternately combined with the neuromuscular therapy and application of ice therapy to the tissue surrounding the flexor cavity. The musculature of the upper forearm, particularly of the medial epicondyle, is manipulated to further induce elongation and/or muscle and tendon displacement, but primary emphasis is on cross fiber friction to encourage adhesion separation and entrapped nerve release while maintaining elongation. Isomeric contraction exercises are instituted to encourage generation of muscle tone at their elongated arrangement and combat a tendency of the elongated and/or longitudinally displaced musculature to retract.

From the aforesaid, it can be seen that the manipulative therapeutic method of the invention is based upon complimentary functional principles, being the attaining of a normal cross sectional flexor cavity by reduction of inflammation and increase in circulation through neuromuscular therapy and/or manipulation, and the reduction of pressure against the median nerve from the palmaris longus, which may be caused by the repetitive motion, stress and/or displacement among the tendons passing through the cavity with the median nerve.

The extent and nature of the invention will be apparent from the following detailed description of the invention.

BRIEF DESCRIPTION OF THE DRAWINGS

FIG. 4 comprises a diagrammatic illustration of movement in a forearm musculature stretching exercise.

FIG. **4*a*** comprises a diagrammatic illustration of movement in a further forearm musculature stretching exercise.

FIG. **4*b*** comprises a diagrammatic illustration of movement in another forearm musculature stretching exercise.

Figure 5:
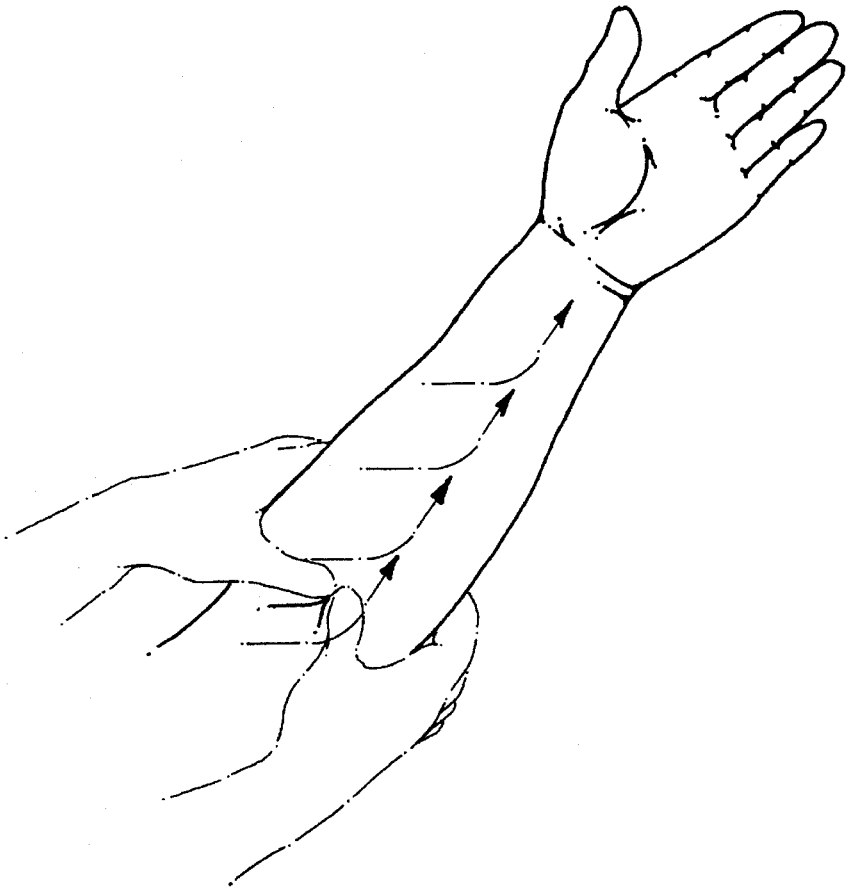

FIG. 5 comprises a diagrammatic illustration of a deep tissue manipulation method in accord with the invention.

Figure 6:
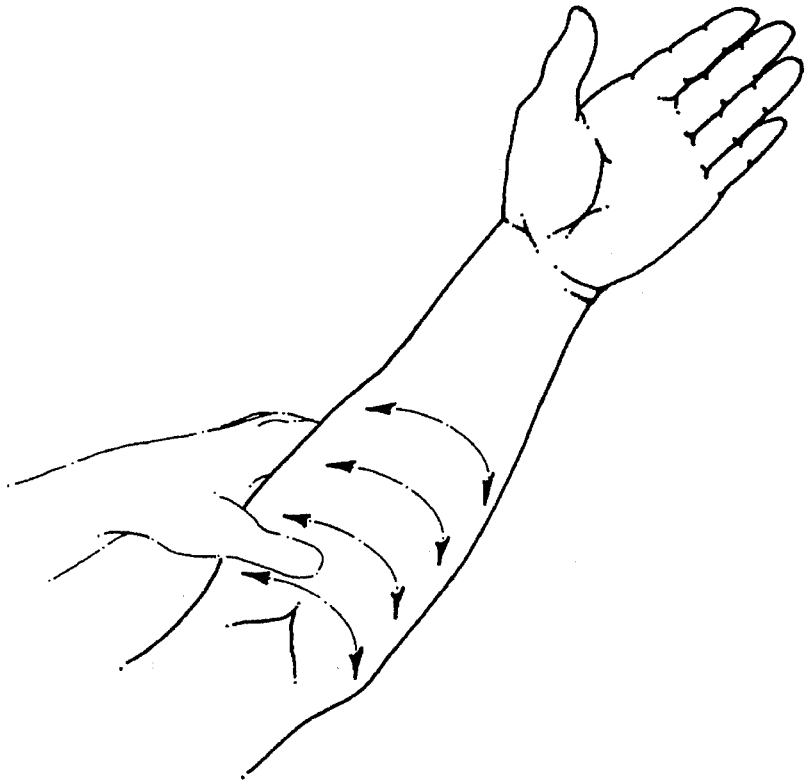

FIG. 6 comprises a diagrammatic illustration of a cross fiber manipulation method in accord with the invention.

Figure 7:
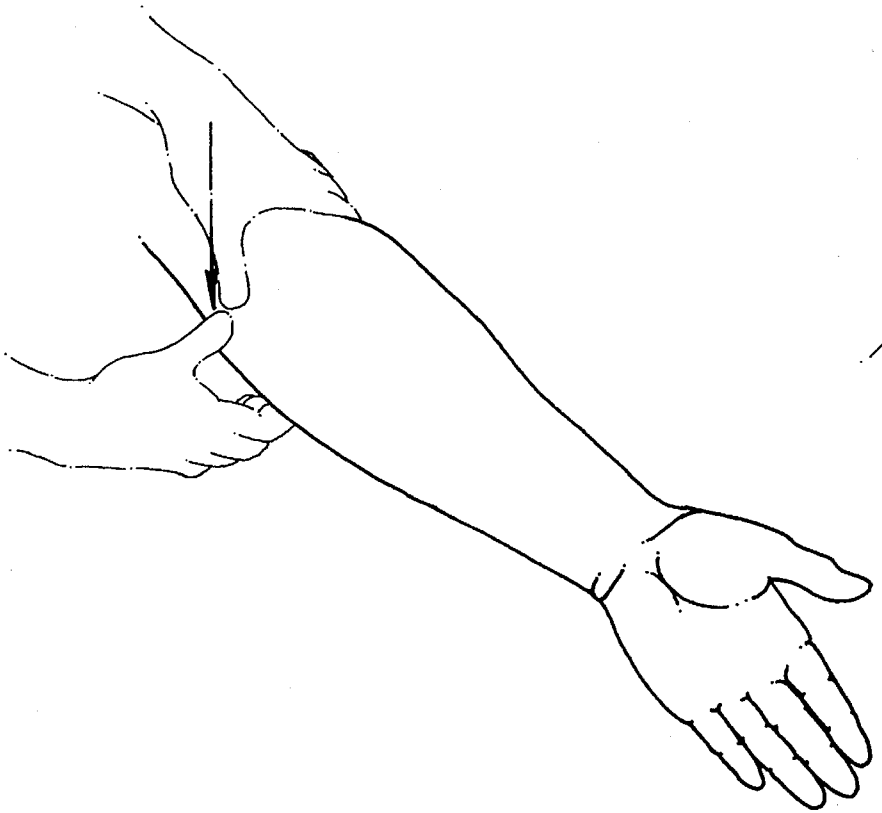

FIG. 7 comprises a diagrammatic illustration of a trigger point manipulation method in accord with the invention.

Figure 8:
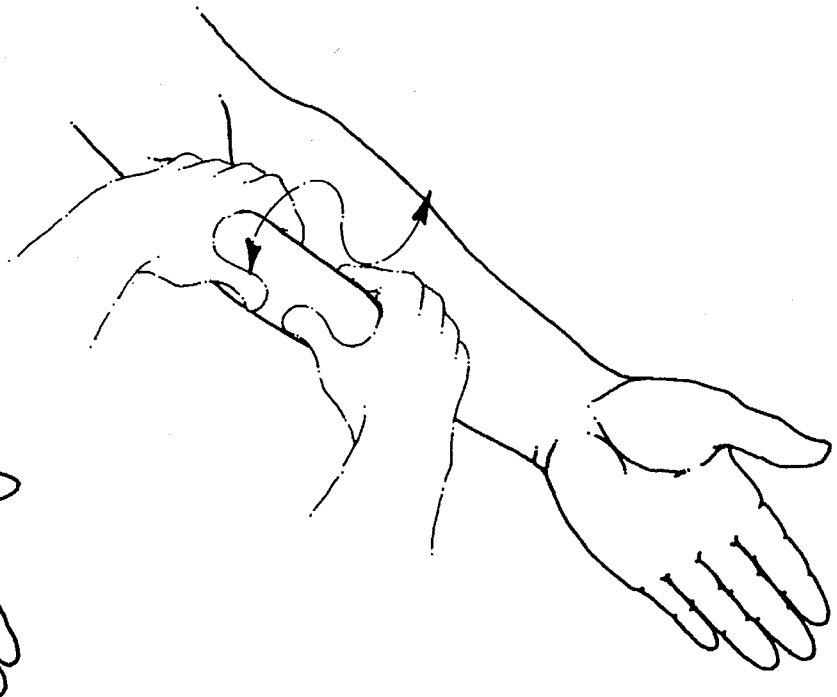

FIG. 8 comprises a diagrammatic illustration of a skin roll manipulation method of the invention.

Figure 9:
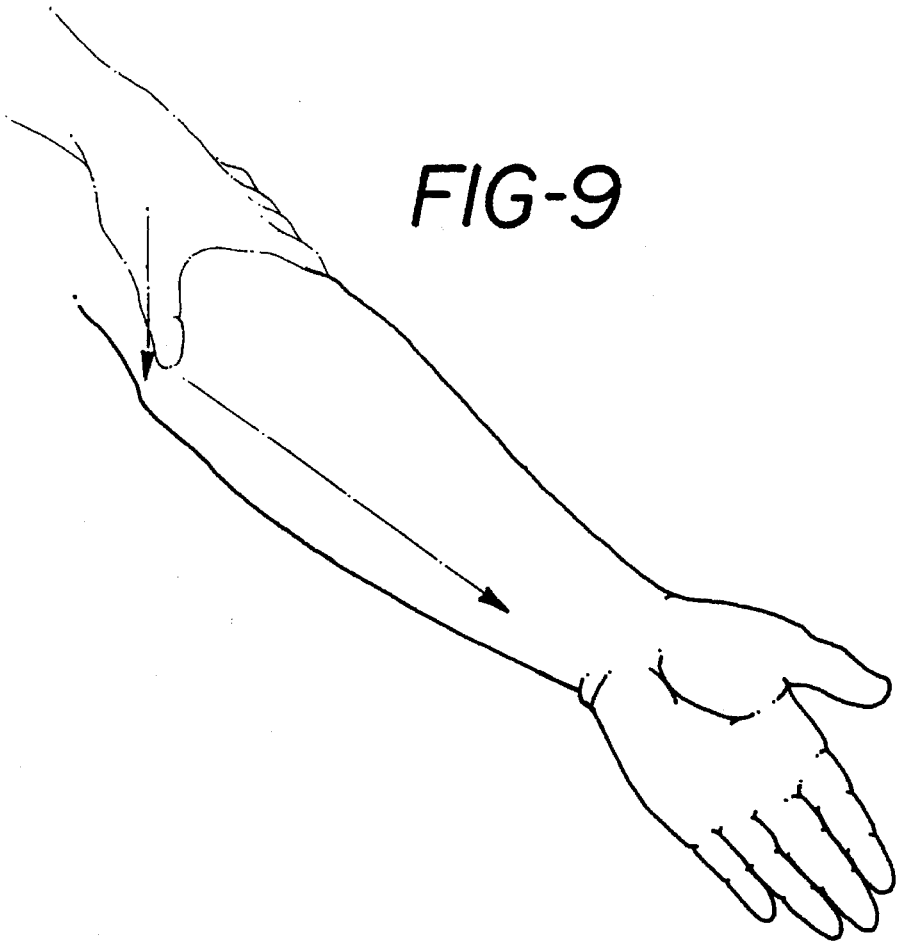

FIG. 9 comprises a diagrammatic illustration of trigger point pressure manipulation in accord with the invention.

DETAILED DESCRIPTION OF THE INVENTION

Figure 1:
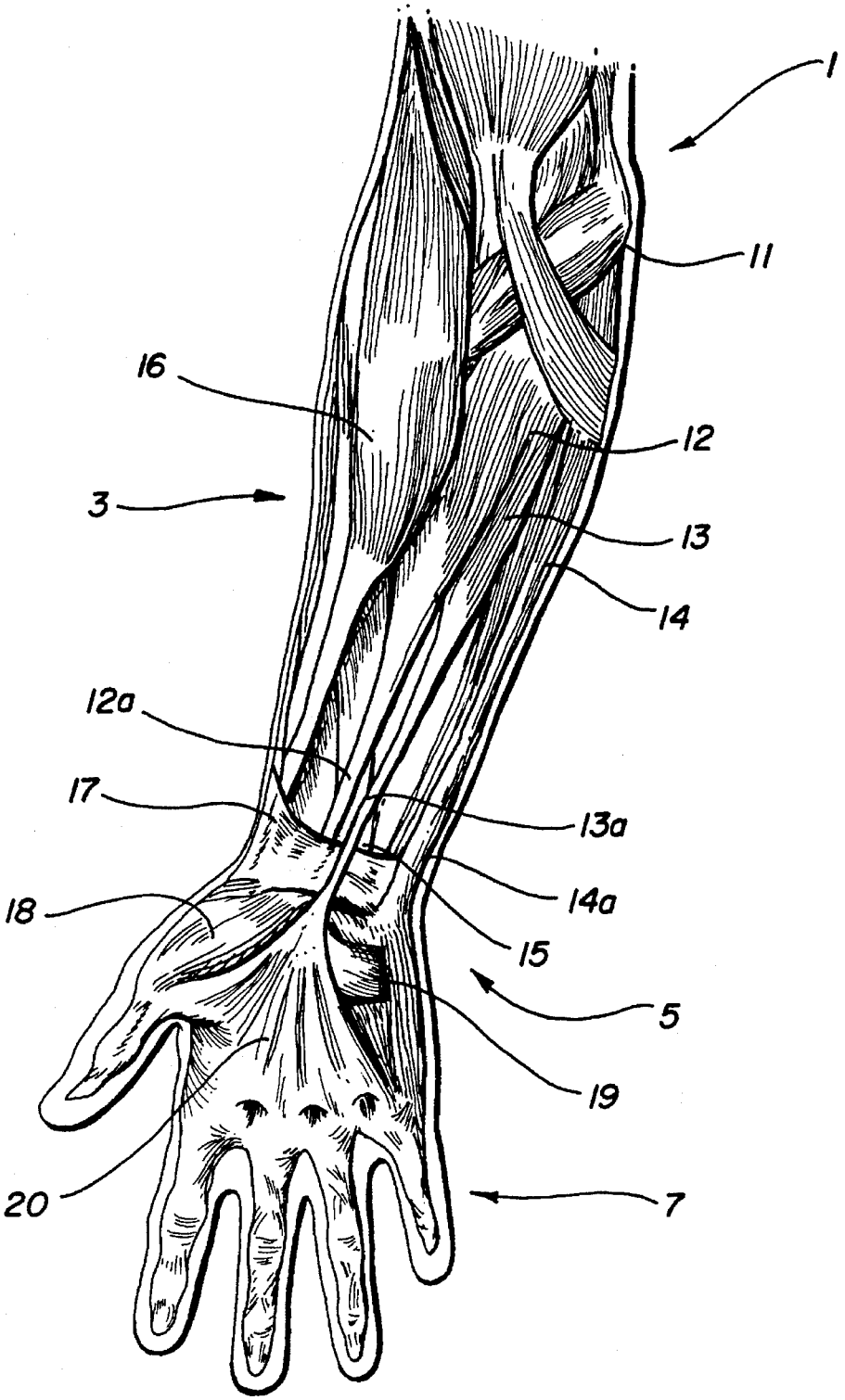
FIG. 1 comprises a diagrammatic, palm up, illustration of an arrangement of muscles and tendons of the elbow, forearm, wrist and palm of a human.
Figure 2:
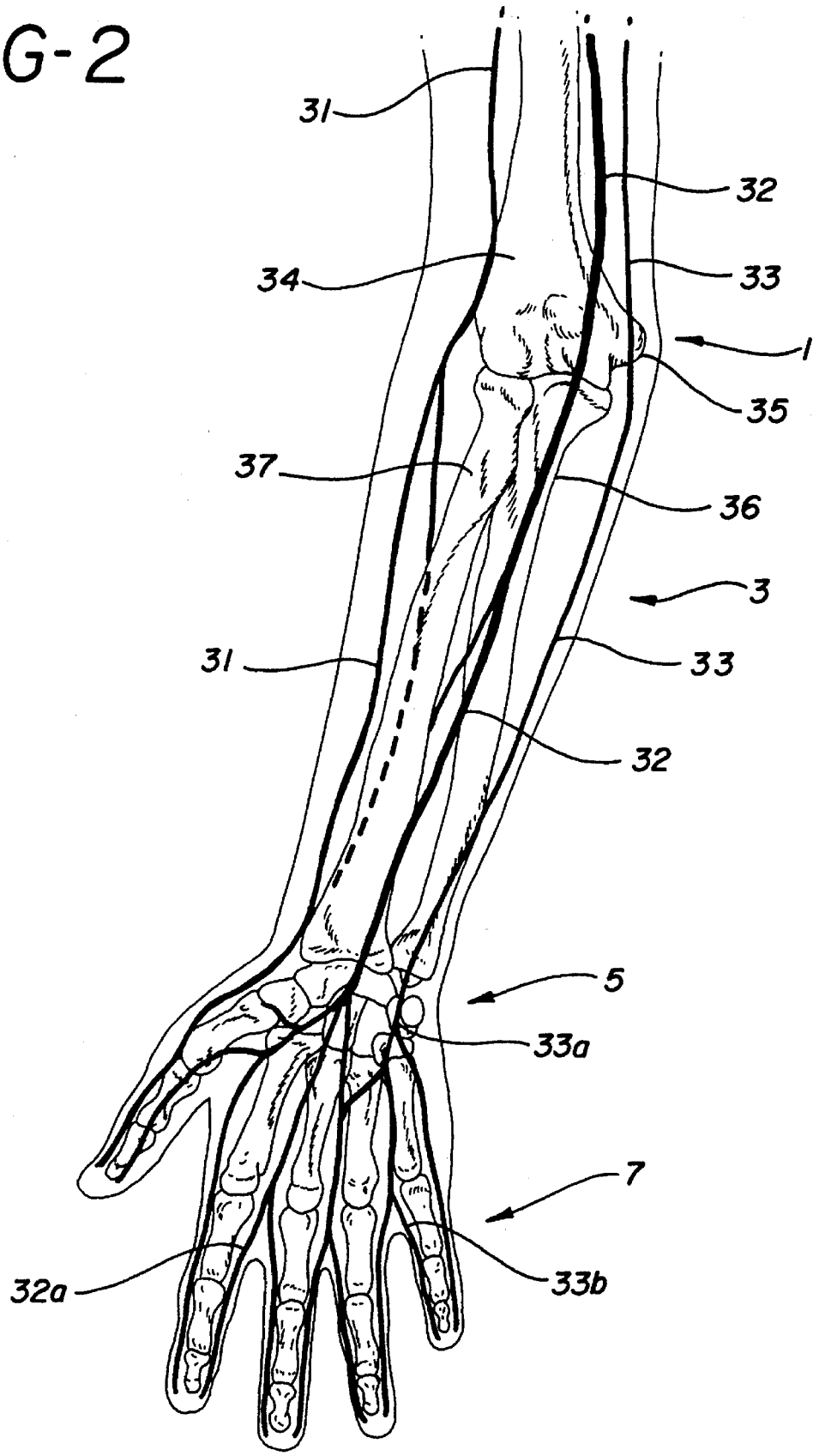
FIG. 2 comprises a diagrammatic, palm up, illustration of an arrangement of bones and nerves of the elbow, forearm, wrist and palm of a human.
Figure 3:
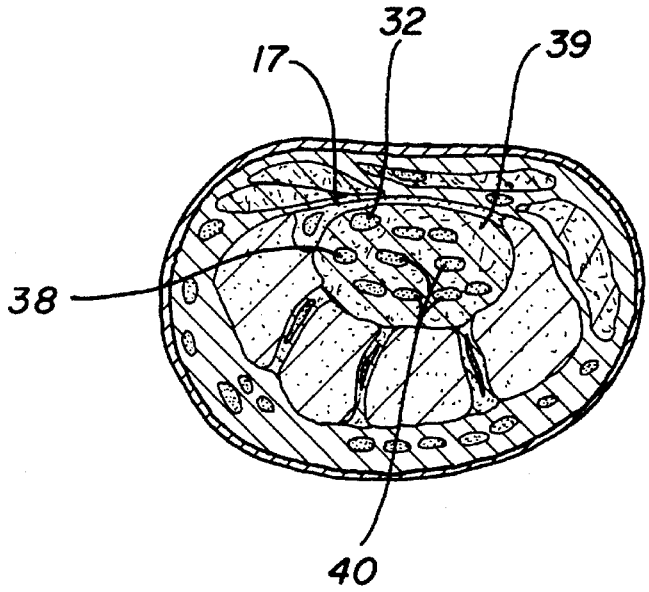
FIG. 3 comprises a diagrammatic, cross sectional illustration of an arrangement of tendons and nerves of a human wrist.

Referring now to the drawings, FIGS. 1–3 illustrate the relative arrangement of nerves and musculature of the human arm and hand to which the present method is applied. FIGS. 4–9 illustrate preferred location and paths for manipulation at various stages of the present method.

In FIGS. 1–3, is shown a human right forearm 3, turned at elbow 1 and wrist 5 with hand 7 in a palm up position. The illustrated musculature includes pronator teres 11, flexor carpi radialis 12, tendon of flexor carpi radialis **12*a*, palmaris longus 13, palmaris longus tendon 13*a*, flexor carpi ulnaris 14, flexor digitorum profundus 15, tendon of the flexor carpi ulnaris 14*a*, brachioradialis 16, antebrachial fascia 17, abductor pollices brevis 18, palmaris brevis 19 and palmar aponeurosis 20. The illustrated bone structure includes humerus 34, medial epicondyle 35, radius 37 and ulna 36. The illustrated nerves include radial nerve 31, median nerve 32, ulnar nerve 33, superficial branch of the ulnar nerve 33*a*, digital branch of the ulnar nerve 33*b* and digital branch of the median nerve 32*a***.

FIG. 3 illustrates an arrangement of tendons and soft tissue generally within the carpal tunnel of the wrist. Therein is illustrated the relative arrangements of flexor retinaculum 17, median nerve 32, flexor pollices longus 38, ulnar bursar 39 and various flexor tendons 40 extending therethrough.

In the first stage of the method of the invention, the forearm, elbow, wrist and hand are exercised in such manner as to stretch forearm musculature and soft tissue of the hand and wrist are manipulated to reduce inflammation and increase circulation about the flexor cavity.

In the stretching exercise, a primary objective is to elongate muscles appended to tendons which pass through and about the carpal tunnel and stretch the tendon to reduce the foreshortened muscles and tendons in the area of the carpal tunnel. FIGS. 4, 4*a* and 4*b* illustrate preferred stretching movements of the method of the invention. In FIG. 4, the arm is straight, the elbow unbent, and with the palm up the hand is bent downwardly to stretch the musculature and tendons in the forearm. In FIG. 4*a*, the arm is straight, the elbow unbent, and with the palm down the hand is bent downwardly to stretch the musculature and tendons of the forearm. In either exercise the forearm may be rotated, preferably clockwise, at the elbow. In FIG. 4*b*, again the elbow is straight and the hand is bent laterally, preferably in a direction away from the thumb and generally referred to as a karate chop movement. The hand is bent and rotated about the elbow preferably to the limit of natural motion. Measurement of the extent of unassisted flexion movement of each patient is generally taken prior to the initiation of assisted movement and care must be taken to assure that the patient is subjected to minimal or no discomfort and/or that natural limits are not exceeded such that tearing and/or rupturing of a tendon or muscle occurs.

First stage stretching and second stage soft tissue manipulation are preferably applied in alternating sequence. FIG. 5 illustrates soft tissue manipulation, wherein moderate digital pressure, sufficient in intensity to distend the soft tissue but at a level of intensity that invokes little if no discomfort to the patient, is applied along the elongate muscle fibers of the forearm, generally at an angle to the elongate muscle fiber, downwardly and across the muscle fibers. FIG. 6 illustrates progressive cross fiber manipulation wherein moderate digital pressure is applied across the longitudinal axis of the muscle to promote cross fiber friction and reduce facia congestion and increase circulation of the musculature. The focus of this manipulation is to provide rejuvenation to muscles which were tired by exercise, by fostering the circulation of blood therethrough. The completion of these stages of the method is accompanied by an increase in unassisted stretching movement by the patient.

In a third stage of the method, a primary objective is to promote a retention of the elongation of musculature in the forearm that accompanies movement of the digits. Deep tissue manipulation is imposed, by applying stronger digital pressure than used in soft tissue manipulation, generally at a level of intensity that invokes the least minimal pain in the patient. FIG. 7 illustrates a preferred starting location and path of deep tissue manipulation of the forearm generally beginning at a point nearest the elbow, preferably at a point of median nerve sensitivity with the medial epicondyle of the humerus, and progressing to an area nearest the wrist.

In FIG. 8, strong digital pressure is applied generally perpendicular to the muscle and continuously progressively angularly along its length toward the wrist in such manner as to induce a muscular elongation tension release from its point of attachment at about the elbow to the point of pressure. It is believed that such manipulation provides a beneficial tension release to the muscle in that it induces elongation relaxation to individual fibers comprising the greater muscle mass positioned nearer the elbow. It is believed that as the pressure is progressively moved downward toward the wrist nerve entrapment release is promoted. The progressive longitudinal manipulation effort is generally interspaced with moderate progressive cross fiber manipulation to promote cross fiber friction and reduce facia congestion and increase circulation of the musculature.

Trigger point therapy is also instituted during the deep tissue manipulative process, starting with strong digital pressure at a hyperirritable spot as illustrated in FIG. 9, among a taunt band of skeletal or facia muscle and progressing angularly along the flexor carpi radialis and palmaris longus progressively toward the wrist. Trigger point therapy is believed to cause at least some neuromuscular repositioning so as to lengthen or slacken the musculature appending tendons passing through the carpal tunnel, reduce the facia congestion of the musculature to promote increased circulation, muscular elongation and normalize the median nerve.

In a fourth stage of the method, the objective is to further reduce inflammation and normalize relaxation and/or displacement of tendons in the flexor cavity. In this stage, soft tissue manipulation of the flexor cavity is instituted, alternately combined with the application of ice therapy to the tissue surrounding the flexor cavity. The musculature of the upper forearm is intermittently deep tissue manipulated in accord with FIGS. 7 and 8 to further increase circulation and encourage adhesion separation and entrapped nerve release while maintaining elongation. Isomeric contraction exercises are instituted to encourage generation of muscle tone at their elongated arrangement and combat a tendency of the elongated and/or longitudinally displaced musculature to retract.

In the practice of the method of the invention, three patients who had been diagnosed as having severe carpal tunnel syndrome and were under medical contemplation of invasive surgery were subjected to the method of the invention in eight weekly, one-hour treatment sessions. Prior to treatment, each of the patients expressed feelings of pain in the wrist, a reduction in grip strength and general numbness of the fingers which left them unable to complete their normal activities.

First stage stretching exercises varied from patient to patient, however, each patient was subjected to generally equivalent soft and deep tissue manipulation in each of the four stages, being about 20 minutes for each application of soft tissue manipulation in a stage and 20 minutes for each application of deep tissue manipulation in a stage. Ice therapy was applied on an as needed basis. Each of the three patients displayed a marked improvement in reduction of symptoms within completion of the fourth treatment session and all indicated that numbness and pain were gone, range of movement was increased and that they were able to return to their normal activities after eight treatment sessions.

I claim:

1. A neuromuscular manipulative method for alleviating carpal tunnel syndrome, comprising: subjecting a forearm, elbow, wrist and hand of a human evidencing said syndrome to flexion and extension movement sufficient to stretch at least one of the flexor digitorum profundus, flexor digitorum superficialis, flexor carpi radialis, brachioradialis, palmaris longus and flexor retinaculum muscles; manipulating and massaging the palmaris longus by applying moderate digital pressure progressively along the direction of muscle fibers, intermittently with applying digital pressure progressively across the direction of muscle fibers in an amount sufficient to reduce inflammation and increase blood circulation therein; manipulating deep tissue forearm musculature extending from the vicinity of the elbow to the wrist and appended to tendons traversing the flexor cavity, by applying strong digital pressure progressively longitudinally along the musculature of the forearm in a direction from the elbow toward the wrist in a manner sufficient to promote taunt band release of said musculature; manipulating said forearm musculature with progressive digital pressure manipulation sufficient to promote increased blood circulation in said musculature; applying deep tissue trigger point digital pressure manipulation to said palmaris longus, starting at the medial epicondyle and progressing downwardly along the flexor cavity of the forearm toward the wrist sufficient to reduce facia congestion and inflammation thereof; and manipulating said palmaris longus with progressive digital pressure manipulation sufficient to promote increased blood circulation and to encourage adhesion separation.

2. The method of claim 1 wherein said flexion and extension movement comprises repetitive bending, outstretching and rotating of the forearm at the elbow to the limit of natural motion with applied assistance.

3. The method of claim 2 wherein said flexion and extension movement comprises repetitive bending of the hand flexion and extension movement about the wrist to the limit of natural motion with applied assistance.

4. The method of claim 1 wherein measurement of the extent of unassisted flexion and extension movement of the wrist, hand and forearm is taken prior to the initiation of assisted movement.

5. The method of claim 4 wherein flexion and extension movement and soft tissue manipulation are applied in alternating sequence, and completion thereof is measured by an increase in the extent of unassisted stretching movement.

6. The method of claim 1 wherein cold therapy is applied to said forearm after application of at least one of said digital pressure manipulation.

* * * * *